US010400457B2

(12) United States Patent
Simon

(10) Patent No.: US 10,400,457 B2
(45) Date of Patent: Sep. 3, 2019

(54) SYNTHETIC MULTILAYER FLOOR COVERING

(71) Applicant: Tarkett GDL S.A., Lentzweiler (LU)

(72) Inventor: Jean-Yves Simon, Chiny (BE)

(73) Assignee: Tarkett GDL S.A., Lentzweiler (LU)

( * ) Notice: Subject to any disclaimer, the term of this patent is extended or adjusted under 35 U.S.C. 154(b) by 0 days.

(21) Appl. No.: 15/822,693

(22) Filed: Nov. 27, 2017

(65) Prior Publication Data

US 2019/0161975 A1 May 30, 2019

(51) Int. Cl.

| | |
|---|---|
| ***G06F 15/02*** | (2006.01) |
| ***E04F 15/02*** | (2006.01) |
| *E04F 15/16* | (2006.01) |
| *E04F 15/10* | (2006.01) |

(52) U.S. Cl.

CPC ..... *E04F 15/02038* (2013.01); *E04F 15/105* (2013.01); *E04F 15/16* (2013.01)

(58) Field of Classification Search

CPC ... E04F 15/02038; E04F 15/16; E04F 15/105; E04F 15/02; E04F 2201/0115; E04F 2201/0138; E04F 2201/023; E04F 15/107; E04F 2201/0107; E04F 15/10

USPC ..... 52/588.1, 591.1

See application file for complete search history.

(56) References Cited

U.S. PATENT DOCUMENTS 7,584,583 B2 * 9/2009 Bergelin ..... E04F 15/02 52/588.1
7,763,345 B2 * 7/2010 Chen ..... B29C 65/564 428/195.1
8,549,807 B2 * 10/2013 Meersseman ..... B32B 7/12 52/313
8,720,144 B2 * 5/2014 Keane ..... E04F 15/02038 52/309.4
8,857,127 B2 * 10/2014 Windmoller ..... E04F 15/02 52/588.1
9,234,357 B2 * 1/2016 Dossche ..... B32B 21/04
9,249,582 B1 * 2/2016 Anspach ..... E04F 15/02038
(Continued)

FOREIGN PATENT DOCUMENTS

LU 92866 B1 8/2017
WO WO 97/47834 A1 12/1997

*Primary Examiner* — Brian E Glessner
*Assistant Examiner* — Adam G Barlow
(74) *Attorney, Agent, or Firm* — Reinhart Boerner Van Deuren P.C.

(57) ABSTRACT

A synthetic multilayer floor covering has floor panels, each of which comprises at least a first and a second edge with a first and a second connecting profile, respectively. The connecting profiles are complementarily shaped so that adjacent floor panels may be coupled to one another. The first connecting profile of a first floor panel and/or the second connecting profile of a second floor panel is deformed when connecting profiles become coupled with each other. The deformation comprises a component that persists as the connecting profiles remain coupled. The persistent deformation results in stress within the connecting profiles, which are made of viscoelastic material. That material undergoes significant stress relaxation. At standard ambient temperature and pressure, the stress within the first and/or the second connecting profile decreases by at least 40% within 12 hours after the connecting profiles have become coupled.

16 Claims, 3 Drawing Sheets

(56) References Cited

U.S. PATENT DOCUMENTS

| | | | | |
|---|---|---|---|---|
| 2009/0193741 | A1* | 8/2009 | Cappelle | E04F 15/02 52/309.1 |
| 2011/0167744 | A1* | 7/2011 | Whispell | E04F 15/02 52/309.1 |
| 2012/0017533 | A1* | 1/2012 | Pervan | E04F 15/02 52/588.1 |
| 2016/0177576 | A1* | 6/2016 | Ramachandra | E04F 15/02016 52/588.1 |
| 2016/0177578 | A1* | 6/2016 | Ramachandra | E04F 15/041 52/588.1 |
| 2017/0037640 | A1* | 2/2017 | Boucke | E04F 15/02038 |

* cited by examiner

SYNTHETIC MULTILAYER FLOOR COVERING

FIELD OF THE INVENTION

The invention generally relates to a synthetic (also called polymer-based or polymeric) floor covering composed of individual floor panels (in the form of tiles, planks, strips or the like), which are laid out, side by side, on the underfloor (the floor to be covered). The floor covering according to the invention may be installed as a floating floor covering (without direct attachment to the subfloor) or as a glued floor covering.

BACKGROUND OF THE INVENTION

Synthetic surface coverings are well known. Generally they are made of rubber, polyolefins, polyesters, polyamides or PVC. They present specific mechanical properties, particularly in terms of mechanical resistance, wear and indentation resistance, but also in terms of comfort, softness, sound and heat insulation.

In the context of the present document, laminate floor coverings with a fibreboard core are not considered synthetic floor coverings.

Among polymer-based surface coverings, two main categories can be identified. Homogenous surface coverings are coverings comprising agglomerated particles, generally obtained by cutting or shredding a sheet made from a composition which comprises a polymer-based material, and wherein no bottom layer, or backing, conferring structural stability to the surface covering, is used. Heterogeneous or multilayer surface coverings are coverings comprising one or more lower layers and one or more transparent upper layers (wear layer and, possibly, a hard top varnish). These coverings may comprise a decorative pattern imitating the aesthetic appearance of natural floorings such as wood or stone floorings. Such decorative pattern may be printed on the bottom face of the wear layer, on the top face of a core or support layer or on an additional layer (print layer) that is inserted between the core or support layer and the wear layer.

Floor covering elements (hereinafter: floor panels) with conjugate connection profiles are known in the art. One of their simplest embodiments comprises a tongue profile (or male profile) and a groove profile (or female profile). Each floor panel has one or two edges (lateral faces) with a tongue profile and the opposite one or two edges are provided with respectively complementary groove profiles. While such profiles have first been used on wood floor panels, they have meanwhile also been applied to laminate floor panels. For instance, WO 97/47834 discloses a floor covering, consisting of hard floor panels (i.e. laminate panels with a fibreboard base or wood panels) which, at least at the edges of two opposite sides, are provided with coupling parts, cooperating with each other, substantially in the form of a tongue and a groove. The coupling parts, which are integrated into the floor panels, mechanically interlocking in order to prevent two coupled floor panels from drifting apart into a direction perpendicular to the adjacent edges and parallel to the underside of the coupled floor panels. In the engaged state of two floor panels, the coupling parts are slightly elastically deformed in such a way that they exert on each other a tension force that urges the floor panels toward each other.

SUMMARY OF THE INVENTION

A first aspect of the invention relates to a synthetic multilayer floor covering, comprising floor panels, each of which comprises at least a first and a second edge with a first and a second connecting profile, respectively. The first and second connecting profiles are complementarily shaped in such a way that adjacent floor panels may be coupled to one another via the first and second connecting profiles. The shapes of the first and second connecting profiles are such that at least one of the first connecting profile of a first floor panel and the second connecting profile of a second floor panel is deformed when the first and second connecting profiles become coupled with each other. The deformation comprises a component that persists (i.e. at least part of the deformation persists) as the first and second connecting profiles remain coupled, the persistent component resulting in stress within the first and/or the second connecting profile. An advantageous feature is that the first and/or the second connecting profiles are made of viscoelastic material, which undergoes significant stress relaxation. Specifically, at standard ambient temperature and pressure, the stress within the first and/or the second connecting profile decreases by at least 40% within 12 hours after the first and the second connecting profiles have become coupled.

As used herein, the conditions of "standard ambient temperature and pressure" mean room temperature (i.e. 25 C) and normal atmospheric pressure (i.e. 1013.25 hPa). The reduction of stress is indicated relative to the value which is reached immediately (at most 5 s) after two previously unused connecting profiles are connected to each other. It is worthwhile noting that due to the viscoelastic properties of the material(s) of the connecting profiles, the deformation persists permanently or for a long time after two connecting profiles have been separated and that, hence, the same stress relaxation will not be measured on connecting profiles that have been in use before. From this consideration, it is also apparent that there are at least two factors that have an impact on stress relaxation, in particular the initial strain (which depends on the geometry of the first and second connecting profiles) and the type of viscoelastic material used.

Unlike in hard floor panels (such as fiberboard laminate or wood panels), the restore forces that the coupled connecting profiles exert upon each other (due to their elasticity) fade away very quickly. Contrary to what one would have readily expected, that phenomenon has no serious detrimental effects on the durability of the floor covering. In particular, it was not observed that the floor panels of a floating floor covering became loose over time. One may speculate that friction forces take over the role of the tension but there may be other theoretical explanations, which, accordingly, shall not limit the present invention.

Further to the surprisingly good coherence of the floor covering, it was discovered that mechanical strain distributes more easily and more evenly over larger areas (i.e. over several neighboring floor panels), thereby reducing mechanical stress within the individual floor panels. Strong tension between engaged connecting profiles may prevent small movements (in the sub-millimeter range) of the individual panels relative to each other, leading to a local build-up of stress (e.g. as a consequence of temperature and/or humidity variations). The effect may be more pronounced in some areas than in others e.g. due to production tolerances of the connecting profiles. Indeed, small variations in the dimensions of the connecting profiles may lead to important variations in the tensions between adjacent panels a in their ability to dissipate stress, in particular shearing stress in the directions of the edges. One may consider interlocking flooring systems as a small-scale system of tectonic plates. In severe cases, the build-up of stress may lead to noticeable strain of the floor covering (e.g. in the form of bulging) and/or to sudden (but still small) lateral displacements of the floor panels. Such extreme phenomena were not observed on floor coverings according to the first aspect of the invention. With floor coverings according to the first aspect of the invention, no significant build-up of mechanical stress was observed.

Preferably, the mechanical stress within the first and/or the second connecting profile decreases more and/or more quickly. According to a preferred embodiment, at standard ambient temperature and pressure, the stress within the first and/or the second connecting profile decreases by at least 50%, preferably by at least 60% and more preferably by at least 70%, within 12 hours after the first and the second connecting profiles have become coupled. Additionally or alternatively, at standard ambient temperature and pressure, the stress within the first and/or the second connecting profile may decrease by at least 40% within 6 hours, preferably within 2 hours and more preferably within 1 hour, after the first and the second connecting profiles have become coupled. According to a particularly preferred embodiment of the invention, at standard ambient temperature and pressure, the stress within the first and/or the second connecting profile decreases by at least 60% within 1 hour after the first and the second connecting profiles have become coupled. Preferably also, the mechanical stress within the first and/or the second connecting profile decreases to tend towards an asymptotic value at least 70% lower than the initial value.

Preferably, the floor panels comprise a backing substrate, one or more core layers, a decorative print layer on top of the core layers and at least one transparent wear layer on top of the print layer. The core layer is preferably polymer-based (preferably PVC-based and/or thermoplastic) core layer laminated between the backing layer(s) and the wear layer (s). The core layer may comprise a material having a lesser shore hardness than the materials of the backing layer(s) and the wear layer(s). The core layer may itself be composed of one or more layers (hereinafter termed "core sub-layers"). The core sub-layers are preferably consisting of thermoplastic material and/or PVC-based. Preferably, the core layer has a coefficient of dynamic friction comprised in the range from 0.50 to 0.65, more preferably in the range from 0.55 to 0.60, when determined according to European Standard EN 13893.

The floor panels are flexible floor panels. As used herein, the term "flexible" designates a floor panel that can be bent to a radius of curvature of 75 cm, preferably to a radius of curvature of 50 cm, or even to a smaller radius of curvature (e.g. 25 cm or less), without visible deterioration. It will be understood, however, that a synthetic floor panel used in the context of this invention is not totally soft (such as a carpet with a foam backing) but has a firmness or rigidity that makes the floor panel suitable for the secure installation of a floating floor covering by interconnecting the floor panels via their connection profiles.

The synthetic multilayer floor covering (and, hence, each floor panel) preferably has a thickness in the range from 3 mm to 8 mm, more preferably in the range from 3 to 5 mm.

The floor panels may, e.g., be vinyl floor tiles and/or planks, preferably vinyl composition tiles, solid vinyl tiles or luxury vinyl tiles. The floor panels may be PVC-based or PVC-free. Such vinyl floor panels may comprise a urethane wear layer.

The synthetic multilayer floor covering has a decorative top face, which comprises a decorative pattern. The decorative pattern may be of any type, e.g. of the type imitating natural flooring such as wood flooring, bamboo flooring, stone flooring, ceramic flooring or cork flooring. Any other decorative pattern, e.g. a photograph, a drawing or an abstract design, could of course also be used on the top face.

The floor tiles are preferably arranged in rows. The floor tiles of the different rows may be arranged in a staggered manner or be aligned perpendicular to the rows.

Preferably, the first and second connecting profiles are integral with the floor panels. The first and second connecting profiles may e.g. be machined into the first and second edges, respectively. As used herein, "machining" implies the removal of matter (e.g. by cutting away, abrading or the like) from the edges of a blank floor panel using one or more machines.

A second aspect of the invention relates to a rectangular synthetic multilayer floor panel for laying a floor covering. The floor panel according to the second aspect of the invention has a decorative top face and a bottom face for contacting an underfloor, and further:

- a first long edge with a first connection profile, the first connection profile having a recess at the bottom face and a tongue overhanging the recess,
- a second long edge with a second connection profile that is complementary to the first connection profile, the second connection profile having a protrusion at the bottom face and a groove for receiving the tongue of the first profile,
- a first short edge with the first connection profile; and
- a second short edge with the second connection profile.

The shapes of the first and second connecting profiles are such that at least one of the first connecting profile of a first floor panel and the second connecting profile of a second floor panel is deformed when the first and second connecting profiles become coupled with each other, the deformation comprising a component persistent as the first and second connecting profiles remain coupled, the persistent component resulting in stress within the first and/or the second connecting profile. The first and/or the second connecting profiles are made of viscoelastic material such that, at standard ambient temperature and pressure, the stress within the first and/or the second connecting profile decreases by at least 40% within 12 hours after the first and the second connecting profiles have become coupled.

The terms "long" and "short" are used herein to distinguish between the longer and the shorter edges of a rectangular floor panel; they do not imply any particular dimensions in absolute figures.

Preferably, the shapes of the first and second connecting profiles is such that the deformation undergone by the first and/or the second connecting profile during the coupling process also comprises a transient component (i.e. a part of the deformation is only temporary and can be observed only during the coupling process.)

Preferably, the first and second connecting profiles define so-called angling-type connectors. Connecting profiles of this type require the tongue of the first connecting profile (on the panel to be installed) to be angled into the groove of the second connecting profile (of a panel already laid on the floor) whereupon the newly added floor panel is hinged down to the floor. During this movement, the connection profiles deform resiliently and then "snap" into place. The tongue thus becomes locked in the groove such that a separation thereof requires a higher amount of force or a specific relative movement of the profiles. When angling-type connectors are provided on the four edges of each floor panel, the new floor panel to be laid is first angled into the element on the left already in place. Then, the new panel is declined towards the rear and angled into the row behind (as seen from the person who install the floor covering). The latter step requires that the panel(s) on the left follow the movement of the new panel. They are thus also raised at their front and hinged down. Installing such "double-angling-type" floor panels requires some coordination, which is however easily acquired through some practice.

According to a possible embodiment of a floor panel according to the second aspect of the invention, when looking at the floor panel from above the top face, the edges are arranged in the following order in the clockwise direction: 1) the first long edge, 2) the second short edge, 3) the second long edge and 4) the first short edge (hereinafter: the first edge arrangement order). All references to clocks used herein are references to "normal" clocks, i.e. the clockwise sense of rotation is the one indicated by the fingers of a loosely clenched left hand with the thumb pointing towards the observer.

According to a more preferred embodiment of a floor panel according to the second aspect of the invention, when looking at the floor panel from above the top face, the edges are arranged in the following order in the clockwise direction: 1) the first long edge, 2) the first short edge, 3) the second long edge and 4) the second short edge (hereinafter: the second edge arrangement order). It was discovered that the second edge arrangement order greatly facilitates the installation of flexible rectangular floor panels of the double-angling type. Indeed, with flexible floor panels having the mirrored, i.e. the first, edge arrangement order, the installation of a new floor panel on the right of an already installed floor panel frequently led to a partial loosening of the row being installed from the row behind. That risk could be considerably reduced with floor panels having the second edge arrangement order.

When investigating the reasons for the unexpected increase in terms of laying comfort, it was found that the protrusion on the bottom side of the second short edge provided better support for the floor panel on the left of the element being installed, whereby the second angling step became much easier.

Preferably, at standard ambient temperature and pressure, the stress within the first and/or the second connecting profile decreases by at least 50%, preferably by at least 60% and more preferably by at least 70%, within 12 hours after the first and the second connecting profiles have become coupled. Additionally or alternatively, at standard ambient temperature and pressure, the stress within the first and/or the second connecting profile decreases by at least 40% within 6 hours, preferably within 2 hours and more preferably within 1 hour, after the first and the second connecting profiles have become coupled.

BRIEF DESCRIPTION OF THE DRAWINGS

By way of example, a preferred, non-limiting embodiment of the invention will now be described in detail with reference to the accompanying drawings, in which.

DETAILED DESCRIPTION OF A PREFERRED EMBODIMENT

Figure 1:
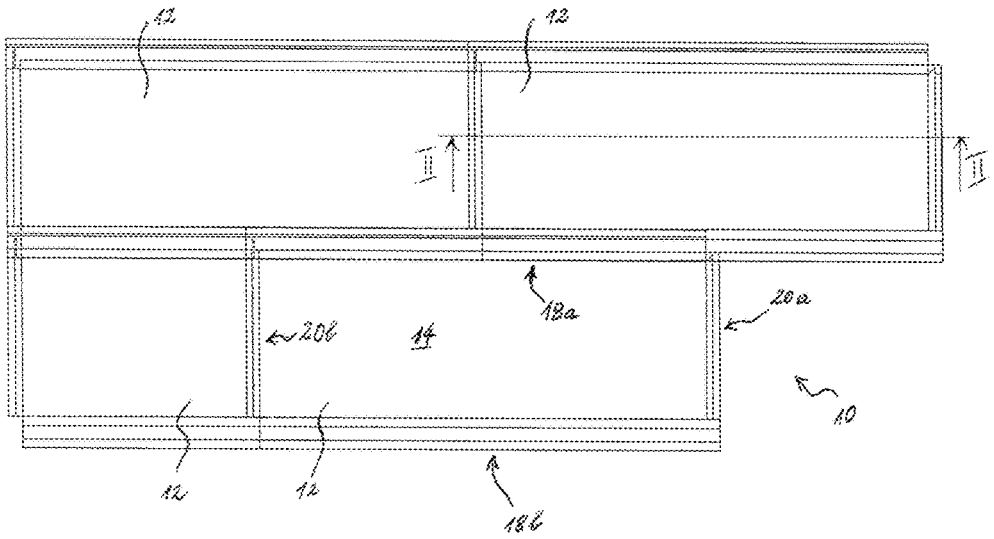
FIG. 1: is a top view of a floor covering consisting of synthetic flexible multilayer floor panels.

FIG. 1 is a schematic top view of a part of a synthetic, heterogeneous floor covering 10 made with flexible flooring panels 12. The flooring panels 12 are of the double-angling type. Each flooring panel 12 has six sides: a decorative top face 14, a bottom face 16 (see FIG. 2) for contacting the underfloor, two long edges 18*a*, 18*b* and two short edges 20*a*, 20*b*. The long edges comprise a first long edge 18*a* equipped with a first connection profile and a second long edge 18*b* opposite the first long edge 18*a* and equipped with a second connection profile that is complementary (conjugate) to the first connection profile. The short edges comprise a first short edge 20*a* equipped with the first connection profile and a second short edge equipped with the second connection profile.

Figure 2:
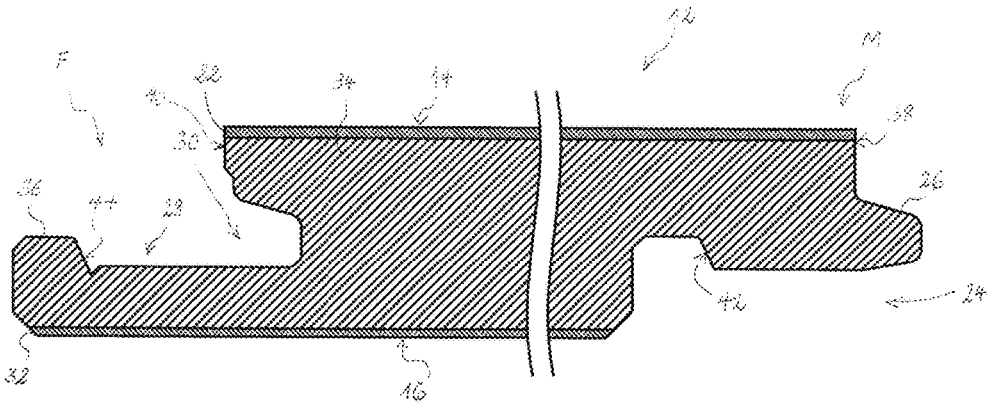
FIG. 2: is a vertical cross-sectional of one of the floor panels shown in FIG. 1.

FIG. 2. Shows one of the floor panels used in the floor covering of FIG. 1 in cross section. The first connection profile, hereinafter termed the "male" profile M for simplicity, has a recess 24 at the bottom face 16 of the floor panel and a tongue 26 overhanging the recess 24. The second connection profile, hereinafter called the "female" profile F, has a protrusion 28 at the bottom face 16 of the floor panel and a groove 30 for receiving the tongue 26 of the male profile M.

In the illustrated embodiment, the structure of the floor panels 12 is as follows. The top face 14 of the floor panels 12 is provided by a transparent wear layer 22, whereas the bottom face 16 is provided by a backing layer 32. The backing layer 32 and the wear layer 22 sandwich a viscoelastic core layer 34. A print layer (not shown) is arranged between the core layer 34 and the wear layer 22. Optionally, one or more barrier layers are provided between the layers so far mentioned in order to reduce migration of chemical compounds (e.g. plasticizers) between the layers. All layers are laminated together to form a multi-layered compound. The PVC-based core layer 34 is softer (i.e. it has a lesser shore hardness) than the backing layer 32 and the wear layer 22 so as to give the floor panel the desired resilience and flexibility. The backing layer 32 and the wear layer 22 balance each other so as to substantially avoid curling of the floor panel 12. Although not shown, the core layer 34 may consist of several sub-layers For instance, the core layer 34 may comprise a fiberglass mat positioned in the mechanically neutral plane of the floor panel 12, which is at least approximately at mid-height of the core layer 34. The fiberglass mat preferably extends into the tongue 26 of the male profile M and/or into the extremity 36 of the substantially L-shaped protrusion 28 of the female profile F. Such a fiberglass mat enhances dimensional stability and strength of the core layer 34. The thickness of such fiberglass mat is preferably comprised in the range from 0.07 to 0.12 mm. Preferably, the fiberglass mat (if any) is coarsely meshed, such that the material of the core layer 34 forms one continuous phase penetrating across the openings and interstices of the fiberglass mat and firmly retaining the latter.

The thickness (or height) of the core layer 34 (including all of its sublayers) preferably amounts to between 0.8 mm and 5.5 mm. The backing layer 32 preferably has a thickness amounting to between 0.4 mm and 1.8 mm. The wear layer 22 preferably has a thickness between 0.2 mm and 1.5 mm. The thickness of the print layer preferably amounts to between 0.05 mm and 0.2 mm. The thicknesses of the different layers are preferably chosen such that the floor panel 12 has a total height of 8 mm or less, e.g. 7 mm, 6 mm, 5 mm, 4 mm, 3.5 mm or 3 mm.

The shapes of the male and female connecting profiles M, F are conjugate to each other meaning that they can be brought into engagement. It should be noted, however, that the contour lines of the male and female profiles are not completely identical in cross section. The male and female profiles can be brought into interlocking engagement. When the tongue 26 of the male profile M is inserted into the groove 30 of the female profile F, a temporary deformation of one or both of the profiles is necessary for the tongue 26 to reach its final position in the groove 30.

Figure 3:
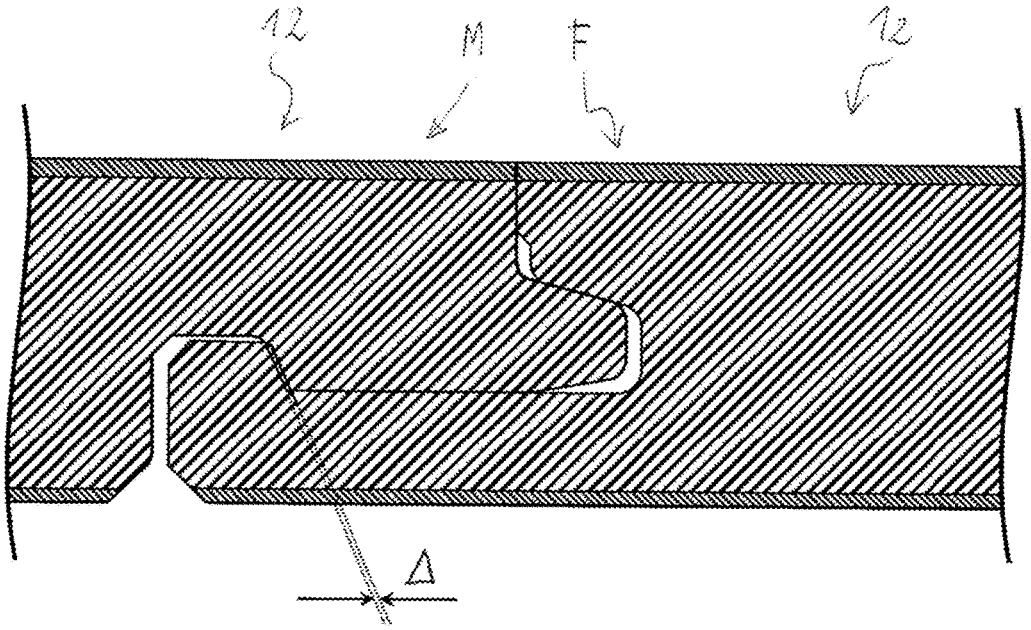
FIG. 3: is a transversal cross-sectional view illustrating how the connecting profiles of the floor panels of FIG. 1 cooperate to couple two adjacent floor panels.

As shown in FIG. 3, when the tongue 26 is completely inserted into the groove 30, there is a residual deformation of at least one of the male and female profiles M, F. Indeed, in the insertion direction, the groove 30 is slightly shorter than the tongue 26. The raised extremity 36 of the protrusion of the female profile, which delimits the groove 30 on the distal side of the female profile F, thus pushes against the rear surface of the tongue 26 of the male profile M. The force exerted on that rear surface 42 corresponds to the stress caused by the persistent component of the deformation of the tongue and/or the protrusion 28. The geometry of the connecting profiles is such that the top front surfaces 38, 40 of the adjacent edges of two connected floor panels 12 are in contact with each other when the male and female profiles M, F are completely engaged with one another. While the surfaces 42 and 44 secure the tongue 26 against slipping out of the groove 30 and keep the top front surfaces 38 and 40 together, the stress generated inside the connecting profiles by the persistent strain decreases relatively fast. The forces that the male and female profiles exert upon each other in the connected state decrease accordingly.

FIG. 3 illustrates that there is a dimensional mismatch A between the shapes of the male and female profiles that leads to a compression of the male profile and/or to stretching of the female profile when the profiles are coupled with each other. The dimensional mismatch preferably amounts to less than 5%, more preferably to less than 2% of the length of the protrusion 28 or the length of the tongue 26 in the insertion direction (i.e. perpendicular to the edge but parallel to the top and bottom faces 14, 16). Under the action of the stress thus generated, the viscoelastic material of the connecting profiles conforms itself to the mechanical constraints by persistent deformation.

Figure 4:
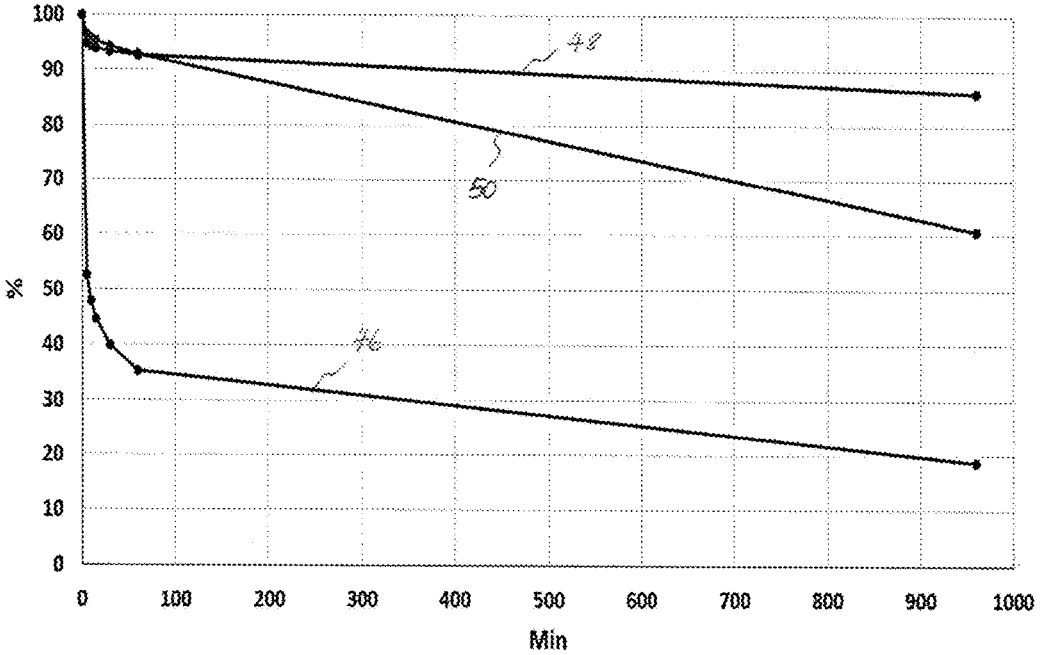
FIG. 4: is a diagram illustrating stress relaxation in floor panels according to the invention in comparison with a hardwood floor panel and a fibreboard laminate floor panel.

FIG. 4 is a graph showing the decrease of stress in viscoelastic PVC, wood and high-density fibreboard subjected to compressive strain. The comparative tests were carried out in the following conditions. The samples were 3 mm thick plates having each a straight edge (lateral face). The samples were obtained by cutting a 3 mm thick slice from the back side of 1) a commercially available hardwood floor panel (that sample consisted of a part of the hardwood core layer and the veneer balancing layer),
2) a commercially available fibreboard laminate floor panel (that sample consisted of a part of the fiberboard core layer and the balancing layer)
3) a synthetic multilayer floor covering with a viscoelastic PVC core (that sample consisted of a part of the viscoelastic PVC core layer and the balancing layer)

The samples were pressed with the straight edge against an abutment using an electronic tension meter which recorded the force that was necessary to maintain 1% compressive strain (i.e. the force that was necessary to reduce the distance between the abutment and the point of application of the force by 1% of the initial distance). The force measured 1 s after the desired strain was reached was taken as the initial value. The necessary forces decrease in time and are expressed as a percentage of the initial value (which is 100%). After 16 hours, the residual stress measured in viscoelastic PVC (curve 46) was below 20%, whereas the residual stress in wood (curve 48) and HDF (curve 50) amounted to 86% and 61%, respectively. It is also remarkable that within the first hour of the test, the stress in viscoelastic PVC decreased by about 65%. It may be worthwhile noting that, in absolute figures, the initial stress values may be significantly different. In the test, initial stress in the wood sample amounted to 12.8 $N/mm^2$, in the laminate sample to 11.8 $N/mm^2$ and in the viscoelastic PVC sample to 4.3 $N/mm^2$.

Figure 5:
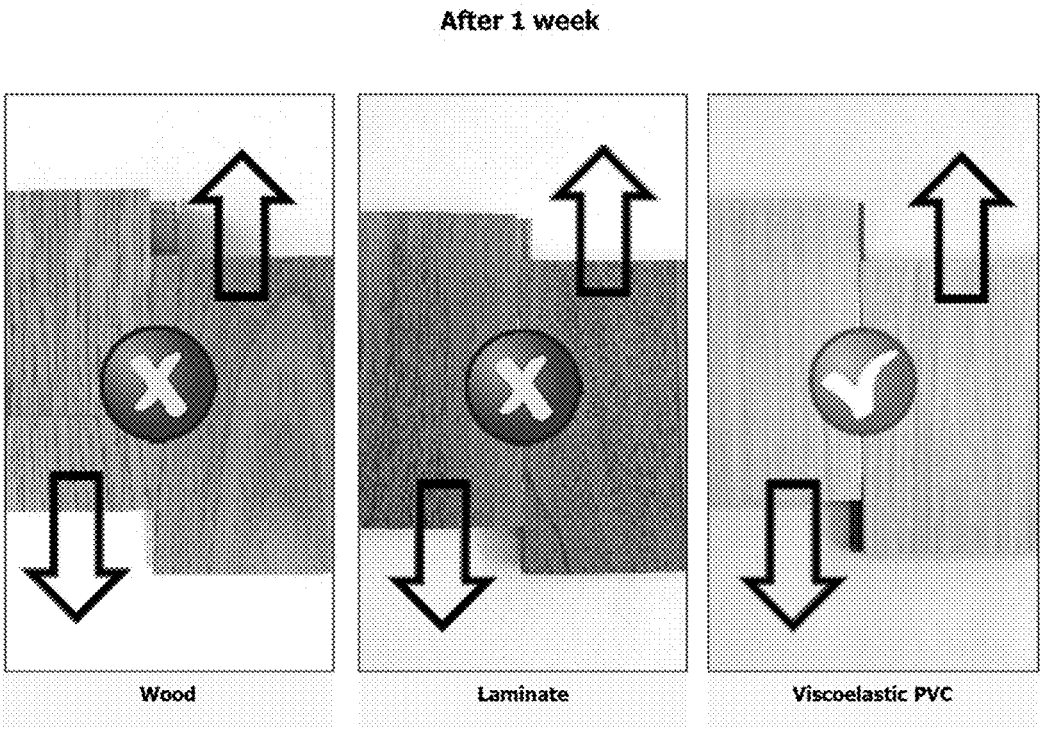
FIG. 5: is an illustration of an empirical test comparing floor panels according to the invention with hardwood floor panels and fibreboard laminate floor panels.

FIG. 5 illustrates an additional comparative test that was conducted using 1) a pair of the commercially available hardwood floor panels, 2) a pair of the commercially available fibreboard laminate floor panels and 3) a pair of synthetic multilayer, viscoelastic-PVC-based floor panels. The panels of each pair were connected with each other and arranged on a flat underground. The connector geometry was the same for all tested pairs. The resistance of the connection against sliding was then tested by hand. Immediately after connecting the floor panels, it was not possible to make the panels slide relative to each other while keeping them engaged with their counterpart. The connected panels were then allowed to rest in the connected state. Temperature and humidity conditions were the same for all samples. After one day, the sliding resistance was tested again. Whereas it was still impossible to make the hardwood floor panels and the fibreboard laminate floor panels slide, the synthetic multilayer panels could be slid using moderate force. After one week, the sliding resistance in the hardwood floor panels and the fibreboard laminate floor panels was still high and allowed no movement but is was still easier to make the synthetic multilayer panels slide.

Turning back to FIG. 1, the configuration of all four edges of the floor panels 12 is now described. When looking at the floor covering element from above the top face (as in FIG. 1), the order of the edges in the clockwise direction is:

1) the first long edge 18*a* (with the male profile—at the 12-o'clock position in FIG. 1),
2) the first short edge 20*a* (with the male profile—at the 3-o'clock position in FIG. 1),
3) the second long edge 18*b* (with the female profile—at the 6-o'clock position in FIG. 1) and
4) the second short edge (with the female profile—at the 9-o'clock position in FIG. 1).

The advantage of that arrangement of the connection profiles can be experienced when laying the floor covering. A floor is typically laid by first laying the rearmost row of floor panels from the left to the right and then installing the next row just in front of it. Except for the first row and the leftmost floor panel in each row, a new floor panel is always added in front and to the right of the panels already in place.

The male and female connectors shown in FIG. 2 are so-called angling-type connectors: when a new floor panel is installed, the user holds it in the orientation described above and shown in FIG. 1. The user then angles the edge on the left of the new floor panel under the overhanging tongue of the floor panel on the left already in place. When the tongue has thereby entered the groove, the new floor panel is hinged down. During this movement, the connection profiles deform resiliently and then snap into place. The male and female profiles are now interlocked with each other such that their separation would require some force or the reverse movement of the profiles. The next step is the connection of the new floor panel with the panel or the panels in the row behind. The user typically holds the new floor panel with both hands. The left hand supports the new panel at the corner of the second long edge 18*b* and the second short edge 20*b* while the right hand supports it at the corner of the second long edge 18*b* and the first short edge 20*a*. The new panel and the panel to its left are already connected with each other. The user now raises the second long edge 18*b* of the new panel, giving the new panel a decline towards the row behind. The panel to the left has to follow that decline because of its engagement with the new panel. At this point, a conventional flexible double-angling floor panel would be likely to disengage from the row behind and the user would have to be quite careful to avoid that. With floor panels having the above-defined second edge arrangement order, the risk of the already installed panels to the left disengaging from the row behind is significantly reduced. Keeping the panel to be installed inclined, the user pushes it with the male profile of the first long edge 18*a* into the female profile of the second long edge of the panel(s) behind it. When the connection profiles are in contact, the user lowers the second long edge 18*b* of the new panel on the underfloor. By that rotational motion of the new panel, the male and female profiles along the long edges become interconnected.

It is worthwhile noting that floor panels with the first edge arrangement order present the same advantage when the rows of panels are laid from right to left. Accordingly, such panels may be regarded as especially well-suited for left-handed persons, who may prefer to install flooring that way.

EXAMPLE

An exemplary embodiment of a synthetic multilayer floor covering has the following structure and composition. From bottom to top the structure comprises a 0.5 mm thick backing layer, a 3.5 mm thick PVC-based viscoelastic core layer, a 0.1 mm thick print layer and a 0.7 mm thick wear layer. The composition of the different layers is indicated hereinafter.

The composition of the core layer is the following:

| Component | Parts by weight |
|---|---|
| PVC | 42 |
| DINCH | 20 |
| Chalk | 35 |
| Ca/Zn stabilizer | 1 |
| Epoxidized soja oil | 2 |

The wear layer has the following composition:

| Component | Parts by weight |
|---|---|
| PVC | 72.5 |
| DINCH | 22.5 |
| Epoxidized Soja oil | 3 |
| Ca/Zn stabilizer | 2 |

The printed layer has the following composition:

| Component | Parts by weight |
|---|---|
| PVC | 40 |
| DINCH | 15 |
| Chalk | 35 |
| $TiO^2$ | 5 |
| Ca/Zn stabilizer | 2 |
| Epoxidized soja oil | 3 |

The backing layer has the following composition:

| Component | Parts by weight |
|---|---|
| PVC | 40 |
| DINCH | 15 |
| Chalk | 35 |
| $TiO^2$ | 5 |
| Ca/Zn stabilizer | 2 |
| Epoxidized soja oil | 3 |

The layers are made in respective calendaring processes starting from dry blends. For each layer, a dry blend is made with all the ingredients. The dry blend (powders) is compound into a twin screw extruder or an internal mixer. The internal temperature out of the compounder is in the range of 160-190° C. The hot compound is feeding a 4-cylinders calender at a temperature between 130 and 195° C.

While specific embodiments have been described herein in detail, those skilled in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

The invention claimed is:

1. A synthetic multilayer floor covering, comprising floor panels, each of which comprises a top face and a bottom face, at least a first and a second edge with a first and a second connecting profile, respectively, the first and second connecting profiles being complementarily shaped in such a way that adjacent floor panels may be coupled to one another via said first and second connecting profiles, the first connecting profile having a recess at said bottom face and a tongue overhanging said recess, the second connection profile having a protrusion at said bottom face and a groove for receiving the tongue of the first profile the shapes of the first and second connecting profiles being such that at least one of the first connecting profile of a first floor panel and the second connecting profile of a second floor panel is deformed when the first and second connecting profiles become coupled with each other, the deformation comprising a component persistent as the first and second connecting profiles remain coupled, the persistent component originating from a dimensional mismatch between the shapes of the male and female profiles and leading to a compression of the male profile and/or to stretching of the female profile, the persistent component resulting in stress within at least one of the first and second connecting profile;

wherein the first or the second or both connecting profiles are made of viscoelastic material such that, at standard ambient temperature and pressure, said stress within the at least one of the first and second connecting profile decreases by at least 40% within 12 hours after the first and the second connecting profiles have become coupled; and wherein the dimensional mismatch amounts to less than 5% of the length of the protrusion or the length of the tongue in the direction perpendicular to the edge but parallel to the top and bottom faces.

2. The synthetic multilayer floor covering as claimed in claim 1, wherein, at standard ambient temperature and pressure, said stress within the at least one of the first and second connecting profile decreases by at least 50% within 12 hours after the first and the second connecting profiles have become coupled.

3. The synthetic multilayer floor covering as claimed in claim 1, wherein, at standard ambient temperature and pressure, said stress within the at least one of the first and second connecting profile decreases by at least 40% within 6 hours.

4. The synthetic multilayer floor covering as claimed in claim 1, wherein, at standard ambient temperature and pressure, said stress within the at least one of the first and second connecting profile decreases by at least 60% within 1 hour after the first and the second connecting profiles have become coupled.

5. The synthetic multilayer floor covering as claimed in claim 1, wherein the floor panels comprise a backing substrate, one or more core layers, a decorative print layer on top of said core layers and at least one transparent wear layer on top of said print layer.

6. The synthetic multilayer floor covering as claimed in claim 1, wherein the floor panels are flexible floor panels.

7. The synthetic multilayer floor covering as claimed in claim 1, wherein the floor panels have a thickness in the range from 3 mm to 8 mm.

8. The synthetic multilayer floor covering as claimed in claim 1, wherein the floor panels are vinyl floor tiles or planks.

9. The synthetic multilayer floor covering as claimed in claim 8, wherein the vinyl floor tiles or planks comprise a urethane wear layer.

10. The synthetic multilayer floor covering as claimed in claim 1, wherein the floor tiles are arranged in rows and wherein the floor tiles of the different rows are arranged in a staggered manner.

11. The synthetic multilayer floor covering as claimed in claim 1, wherein said first and second connecting profiles are machined into said first and second edges, respectively.

12. A rectangular synthetic multilayer floor panel for laying a floor covering, the floor panel having a decorative top face and a bottom face for contacting an underfloor, and further:

a first long edge with a first connecting profile, the first connecting profile having a recess at said bottom face and a tongue overhanging said recess a second long edge with a second connecting profile that is complementary to the first connecting profile, the second connecting profile having a protrusion at said bottom face and a groove for receiving the tongue of the first profile, a first short edge with said first connection profile; and a second short edge with said second connection profile;

the first and second connecting profiles defining angling-type connectors, wherein the shapes of the first and second connecting profiles are such that at least one of the first connecting profile of a first floor panel and the second connecting profile of a second floor panel is deformed when the first and second connecting profiles become coupled with each other, the deformation comprising a component persistent as the first and second connecting profiles remain coupled, the persistent component originating from a dimensional mismatch between the shapes of the male and female profiles and leading to a compression of the male profile and/or to stretching of the female profile, the persistent component resulting in stress within at least one of the first and second connecting profile;

wherein the first or the second or both connecting profiles are made of viscoelastic material such that, at standard ambient temperature and pressure, said stress within the at least one of the first and second connecting profile decreases by at least 40% within 12 hours after the first and the second connecting profiles have become coupled; and wherein the dimensional mismatch amounts to less than 5% of the length of the protrusion or the length of the tongue in the direction perpendicular to the edge but parallel to the top and bottom faces.

13. The rectangular synthetic multilayer floor panel as claimed in claim 12, wherein, when looking at the floor panel from above the top face, the edges are arranged in the following order in the clockwise direction: 1) the first long edge, 2) the first short edge, 3) the second long edge and 4) the second short edge.

14. The rectangular synthetic multilayer floor panel as claimed in claim 12, wherein when looking at the floor panel from above the top face, the edges are arranged in the following order in the clockwise direction: 1) the first long edge, 2) the second short edge, 3) the second long edge and 4) the first short edge.

15. The rectangular synthetic multilayer floor panel as claimed in claim 12, wherein, at standard ambient temperature and pressure, said stress within the at least one first and second connecting profile decreases by at least 50% within 12 hours after the first and the second connecting profiles have become coupled.

16. The rectangular synthetic multilayer floor panel as claimed in claim 12, wherein, at standard ambient temperature and pressure, said stress within the at least one of the first and second connecting profile decreases by at least 40% within 6 hours after the first and the second connecting profiles have become coupled.

* * * * *